United States Patent [19]

Kitko

[11] 4,170,453

[45] Oct. 9, 1979

[54] PEROXYACID BLEACH COMPOSITION

[75] Inventor: David J. Kitko, West Chester, Ohio

[73] Assignee: The Procter & Gamble Company, Cincinnati, Ohio

[21] Appl. No.: 803,107

[22] Filed: Jun. 3, 1977

[51] Int. Cl.[2] ..... C11D 3/395; C11D 7/54

[52] U.S. Cl. ..... 8/111; 252/95; 252/99; 252/186; 260/502 R; 568/561

[58] Field of Search ..... 252/186, 95, 99; 8/107, 8/111; 260/502, 610 A

[56] References Cited

U.S. PATENT DOCUMENTS

| | | | |
|---|---|---|---|
| 2,813,896 | 11/1957 | Krimm | 252/99 |
| 3,639,285 | 2/1972 | Nielson | 252/186 |
| 3,749,673 | 7/1973 | Jones et al. | 252/99 |
| 3,773,673 | 11/1973 | Jenkins et al. | 252/99 |
| 3,956,159 | 5/1976 | Jones | 252/99 |

FOREIGN PATENT DOCUMENTS

| | | |
|---|---|---|
| 814938 | 11/1974 | Belgium . |
| 635620 | 1/1962 | Canada . |

OTHER PUBLICATIONS

Parker, Jour. Am. Chem. Soc., vol. 79, (1957), pp. 1929–1931.

*Primary Examiner*—Benjamin R. Padgett
*Assistant Examiner*—Irwin Gluck
*Attorney, Agent, or Firm*—George Wheeler; Douglas C. Mohl; Richard C. Witte

[57] ABSTRACT

Dry, granular, bleaching compositions comprising an effective amount of diperoxydodecanedioic acid and sufficient buffering agent to control the pH of the aqueous solution in which the bleach is used in the range of 8.7 to 9.5. The peroxyacid and the buffering agent being present as separate granules in such compositions. Methods of using the compositions are also provided.

2 Claims, No Drawings

PEROXYACID BLEACH COMPOSITION

BACKGROUND OF THE INVENTION

The present invention relates to a dry, granular, bleaching composition comprising a peroxyacid compound, diperoxydodecanedioic acid, and sufficient buffering agent to control the pH of an aqueous oslution of the bleach in the range of 8.7 to 9.5.

Peroxygen bleaching agents in general and peroxyacid compounds in particular have long been recognized as effective bleaching agents for use when the adverse color effects of harsh active bleaching agents cannot be tolerated. See, for example, Canadian Pat. No. 635,620, Jan. 30, 1962, to McCune. The peroxyacids used have included aliphatic acids as disclosed in McCune, as well as aromatic acids such as diperoxyisophthalic acid disclosed in U.S. Pat. No. 3,770,816, Nov. 6, 1973, to Nielsen. Use of these agents has necessitated finding adequate solutions to a number of problems. Included in the types of problems heretofore recognized with peroxyacids are the tendency of such materials to undergo exothermic decomposition, the loss of available oxygen from peroxyacids as the result of contact with moisture and heavy metals and the degradation of peroxyacids as the result of contact with alkaline agents.

It has also been discovered that, although diperoxyacids in general are milder to fabrics than chlorine-containing bleaches, they are not entirely free of fabric damage problems. The recognition of certain pinpoint color damage problems with peroxyacids in general is disclosed in Belgium Pat. No. 814,938, Nov. 13, 1974, to Gougeon et al. With the peroxyacid of interest of the present invention, diperoxydodecanedioic acid, nylon color damage can be fairly severe. This damage is due to the bleach active being adsorbed/absorbed onto/into the nylon fiber.

The present inventor has discovered that the abovementioned nylon color damage can surprisingly be reduced by maintaining the pH of the wash solution in which the bleach is used within a certain high pH range, 8.7 to 9.5. It is theorized, although such theory is not to be considered binding, that at the pH's of the present invention the diperoxyacid is more completely ionized and the peroxyacid anion is much less substantive to the nylon fiber. The aforementioned Belgium patent does not suggest that optimized performance (low nylon color damage with high bleach effectiveness) of diperoxydodecanedioic acid would occur in the pH range given above.

Accordingly, it is an object of the present invention to provide an improved fabric bleaching composition having superior bleaching performance.

It is a further object of the present invention to provide a superior method of bleaching fabrics.

These and other objects will become apparent from the description which follows.

As used herein, all percentages and ratios are by weight unless otherwise specified.

SUMMARY OF THE INVENTION

The present invention encompasses a dry, granular composition comprising a peroxyacid compound in the form of diperoxydodecanedioic acid and sufficient buffering agent to control the pH of the water in which the bleach composition is used within the range of about 8.7 to about 9.5. The diperoxyacid and the buffering agent are present as separate granules in the composition. The present invention further encompasses a method of bleaching fabrics with the above composition.

DETAILED DESCRIPTION OF THE INVENTION

The two essential components of the compositions of the present invention are described below.

PEROXYACID BLEACHING COMPONENT

The bleaching agent of the present invention's compositions is diperoxydodecanedioic acid. This acid has the formula

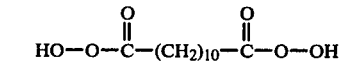

Diperoxydodecanedioic acid is a solid having a solubility in 25° C. water of about 0.1 gram/liter and a decomposition temperature of about 101° C.

Peroxyacids, including the acid of the present invention, can be made in a variety of ways. A common way is to react the parent acid with hydrogen peroxide in the presence of sulfuric acid. Such a method is described in U.S. Pat. No. 2,813,896, Nov. 19, 1957, to Krimm, incorporated herein by reference. An additional method using the same reactants is described in Parker et al., "Peroxides. IV. Aliphatic Diperacids," *Journal American Chemical Society*, 79, pp. 1929–1931, (1957). This reference is also incorporated herein by reference.

The compositions of the present invention contain an amount of the peroxyacid compound to provide adequate bleaching. This amount is generally between about 1% and 60% of the total composition and preferably from about 5% to about 30%.

BUFFERING AGENT

The second essential component of the compositions of the present invention is a buffering agent. As indicated earlier, the present compositions contain sufficient buffering agent to maintain the pH of the water in which the bleach is used within the range of about 8.7 to 9.5, preferably 8.8 to 9.2. To maintain this controlled pH in solution, any noninterfering compound which can alter and maintain pH, such as any standard buffering agent or combination, is employed. For example, alkali metal carbonates, bicarbonates, phosphates, pyrophosphates, borates, silicates and mixtures thereof, which buffer within the range of 8.7 to 9.5. Examples of suitable buffering agents include sodium carbonate, sodium borate decahydrate, sodium phosphate and sodium pyrophosphate. Other buffering compositions for any desired pH can be obtained by the skilled artisan from any standard chemistry handbook or text book.

The amount of buffering agent to provide the pH indicated above is generally from about 2% to about 90% of the total composition, preferably from about 5% to about 30%.

OPTIONAL COMPONENTS

It is well documented in the peroxyacid literature, as noted above, that peroxyacids are susceptible to a number of different stability problems, as well as being likely to cause some problems. Looking at the latter first, peroxyacids decompose exothermally and when the material is in dry granular form the heat generated must be controlled to make the product safe. The best exotherm control agents are those which are capable of liberating water at a temperature slightly below the decomposition temperature of the peroxyacid employed. U.S. Pat. No. 3,770,816, Nov. 6, 1973, to Nielsen, incorporated herein by reference, discloses a wide variety of hydrated materials which can serve as suitable exotherm control agents. Included among such materials are magnesium sulfate $\cdot 7H_2O$, magnesium formate dihydrate, calcium sulfate ($CaSo_4 \cdot 2H_2O$), calcium lactate hydrate, calcium sodium sulfate ($CaSo_4 \cdot 2\text{-}Na_2SO_4 \cdot 2H_2O$), and hydrated forms of such things as sodium aluminum sulfate, potassium aluminum sulfate, ammonium aluminum sulfate and aluminum sulfate. Preferred hydrates are the alkali metal aluminum sulfates, particularly preferred is potassium aluminum sulfate. Other preferred exotherm control agents are those materials which lose water as the result of chemical decomposition such as boric acid, malic acid and maleic acid. The most preferred agent is boric acid. The exotherm control agent is preferably used in an amount of from about 50% to about 200% based on the weight of the peroxyacid compound.

The other problems faced when peroxyacid compounds are used fall into the area of maintaining good bleach effectiveness. It has been recognized that metal ions are capable of serving as catalyzing agents in the degradation of the peroxyacid compounds. To overcome this problem chelating agents can be used in an amount ranging from 0.005% to about 1.00% based on the weight of the peroxyacid to tie up heavy metal ions. U.S. Pat. No. 3,442,937, May 6, 1969, to Sennewald et al., discloses a chelating system comprising quinoline or a salt thereof, an alkali metal polyphosphate and, optionally, a synergistic amount of urea. U.S. Pat. No. 2,838,459, June 10, 1958, to Sprout, Jr., discloses a variety of polyphosphates as stabilizing agents for peroxide baths. These materials are useful herein as stabilizing aids. U.S. Pat. No. 3,192,255, June 29, 1965, to Cann, discloses the use of quinaldic acid to stabilize percarboxylic acids. This material, as well as picolinic acid and dipicolinic acid, would also be useful in the compositions of the present invention. A preferred chelating system for the present invention is a mixture of 8-hydroxyquinoline and an acid polyphosphate, preferably acid sodium pyrophosphate. The latter can be a mixture of phosphoric acid and sodium pyrophosphate wherein the ratio of the former to the latter is from about 0.5:1 to about 2:1 and the ratio of the mixture to 8-hydroxyquinoline is from about 1:1 to about 5:1.

In addition to the above-mentioned chelating systems to tie up heavy metals in the peroxyacid compositions, coating materials may also be used to extend the shelf life of dry granular compositions. Such coating materials may be, in general, acids, esters, ethers and hydrocarbons and include such things as wide varieties of fatty acids, derivatives of fatty alcohols, such as esters and ethers, derivatives of polyethyleneglycols such as esters and ethers and hydrocarbon oils and waxes. These materials aid in preventing moisture from reaching the peracid compound. Secondly, the coating may be used to segregate the peracid compound from other agents which may be present in the composition and adversely affect the peracid's stability. The amount of the coating material used is generally from about 2.5% to about 15% based on the weight of the peroxyacid compound.

Agents which improve the solubility of the peroxyacid product such as sodium sulfate, starch, cellulose derivatives, surfactants, etc., and mixtures thereof are also advantageously used herein. These agents can be called solubilizers and are generally used in an amount from about 100% to about 600% based on the weight of the peroxyacid.

Other agents such as perfumes, whitening agents and bluing agents may also be added to the present compositions.

The bleaching compositions of the instant invention can also be added to and made a part of conventional fabric laundering detergent compositions. Accordingly, optional materials for the instant bleaching compositions can include such standard detergent adjuvants as surfactants and builders. Optional surfactants are selected from the group consisting of organic anionic, ampholytic, and zwitterionic surfactants and mixtures thereof. Optional builder materials include any of the conventional organic and inorganic builder salts including carbonates, silicates, acetates, polycarboxylates and phosphates. Those builders which are suitable buffering agents can be considered to be present in total or in part as a result of serving as the buffering agent described previously. If the instant stabilized bleaching compositions are employed as part of a conventional fabric laundering detergent composition, the instant bleaching system generally comprises from about 1% to about 40% by weight of such conventional detergent compositions. Conversely, the instant bleaching compositions can optionally contain from about 60% to about 99% by weight of conventional surfactant builder materials. Further examples of suitable surfactants and builders are given below.

Water-soluble salts of the higher fatty acids, i.e., "soaps," are useful as the anionic surfactant herein. This class of surfactants includes ordinary alkali metal soaps such as the sodium, potassium, ammonium and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactants includes water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present detergent compositions are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkyl benzene sulfonates, in which the alkyl group contains from about 9 to about 15 carbon atoms in straight chain or branched chain configuration, e.g., those of the type described in U.S. Pat. Nos. 2,220,099, and 2,477,383, incorporated herein by reference.

Other anionic surfactant compounds useful herein include the sodium alkyl glyceryl ether sulfonates, especially those ethers or higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic surfactants herein include the water-soluble salts of esters of $\alpha$-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Preferred water-soluble anionic organic surfactants herein include linear alkyl benzene sulfonates containing from about 11 to 14 carbon atoms in the alkyl group; the tallow range alkyl sulfates; the coconut range alkyl glyceryl sulfonates; and alkyl ether sulfates wherein the alkyl moiety contains from about 14 to 18 carbon atoms and wherein the average degree of ethoxylation varies between 1 and 6.

Specific preferred anionic surfactants for use herein include: sodium linear $C_{10}$–$C_{12}$ alkyl benzene sulfonate; triethanolamine $C_{10}$–$C_{12}$ alkyl benzene sulfonate; sodium tallow alkyl sulfate; sodium coconut alkyl glyceryl ether sulfonate; and the sodium salt of a sulfated condensation product of tallow alcohol with from about 3 to about 10 moles of ethylene oxide.

It is to be recognized that any of the foregoing anionic surfactants can be used separately herein or as mixtures.

Nonionic surfactants include the water-soluble ethoxylates of $C_{10}$–$C_{20}$ aliphatic alcohols and $C_6$ –$C_{12}$ alkyl phenols. Many nonionic surfactants are especially suitable for use as suds controlling agents in combination with anionic surfactants of the type disclosed herein.

Semi-polar surfactants useful herein include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxides containing one alkyl moiety of about 10 to 28 carbon atoms and 2 moieties selected from the group consisting of alkyl groups and hydroxyalkyl groups containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

Ampholytic surfactants include derivatives of aliphatic or aliphatic derivatives of heterocyclic secondary and tertiary amines in which the aliphatic moiety can be straight chain or branched and wherein one of th aliphatic substituents contains from about 8 to 18 carbon atoms and at least one aliphatic substituent contains an anionic water-solubilizing group.

Zwitterionic surfactants include derivatives of aliphatic quaternary ammonium, phosphonium and sulfonium compounds in which the aliphatic moieties can be straight or branched chain, and wherein one of the aliphatic substituents contains from about 8 to 18 carbon atoms and one contains an anionic water-solubilizing group.

The instant granular compositions can also comprise those detergency builders commonly taught for use in laundry compositions. Useful builders herein include any of the conventional inorganic and organic water-soluble builder salts, as well as various water-insoluble and so-called "seeded" builders.

Inorganic detergency builders useful herein include, for example, water-soluble salts of phosphates, pyrophosphates, orthophosphates, polyphosphates, phosphonates, carbonates, bicarbonates, borates and silicates. Specific examples of inorganic phosphate builders include sodium and potassium tripolyphosphates, phosphates, and hexametaphosphates. The polyphosphonates specifically include, for example, the sodium and potassium salts of ethylene diphosphonic acid, the sodium and potassium salts of ethane 1-hydroxy-1,1-diphosphonic acid, and the sodium and potassium salts of ethane-1,1,2-triphosphonic acid. Examples of these and other phosphorus builder compounds are disclosed in U.S. Pat. Nos. 3,159,581; 3,213,030; 3,422,137; 3,400,176 and 3,400,148, incorporated herein by reference. Sodium tripolyphosphate is an especially preferred, water-soluble inorganic builder herein.

Non-phosphorus containing sequestrants can also be selected for use herein as detergency builders. Specific examples of non-phosphorus, inorganic builder ingredients include water-soluble inorganic carbonate, bicarbonate, borate and silicate salts. The alkali metal, e.g., sodium and potassium, carbonates, bicarbonates, borates (Borax) and silicates are particularly useful herein.

Water-soluble, organic builders are also useful herein. For example, the alkali metal, ammonium and substituted ammonium polyacetates, carboxylates, polycarboxylates, succinates, and polyhydroxysulfonates are useful builders in the present compositions and processes. Specific examples of the polyacetate and polycarboxylate builder salts include sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred non-phosphorous builder materials (both organic and inorganic) herein include sodium carbonate, sodium bicarbonate, sodium silicate, sodium citrate, sodium oxydissucinate, sodium mellitate, sodium nitrilotriacetate, and sodium ethylenediaminetetraacetate, and mixtures thereof.

Another type of detergency builder material useful in the present compositions and processes comprises a water-soluble material capable of forming a water-insoluble reaction product with water hardness cations in combination with a crystallization seed which is capable of providing growth sites for said reaction product.

Specific examples of materials capable of forming the water-insoluble reaction product include the water-soluble salts of carbonates, bicarbonates, sequicarbonates, silicates, aluminates and oxalates. The alkali metal, especially sodium, salts of the foregoing materials are preferred for convenience and economy.

Another type of builder useful herein includes various substantially water-insoluble materials which are capable of reducing the hardness content of laundering liquors, e.g., by ion-exchange processes. Examples of such builder materials include the phosphorylated cloths disclosed in U.S. Pat. No. 3,424,545, Bauman, issued Jan. 28, 1969, incorporated herein by reference.

The complex aluminosilicates, i.e., zeolite-type materials, are useful presoaking/washing adjuvants herein in that these materials soften water, i.e., remove Ca++ hardness. Both the naturally occurring and synthetic "zeolites", especially zeolite A and hydrated zeolite A materials, are useful for this builder/softener purpose. A description of zeolite materials and a method of preparation appears in Milton, U.S. Pat. No. 2,882,243, issued Apr. 14, 1959, incorporated herein by reference.

COMPOSITION PREPARATION

The bleaching granules of the present compositions are prepared in any conventional manner such as by admixing ingredients, by agglomeration, by compaction or by granulation.

In one method for preparing the instant compositions a peroxyacid-water mixture containing from about 50% by weight to about 80% by weight of water is combined in proper proportions with any optional components to be utilized within the bleaching granules themselves. Common optional components, as indicated herein earlier, are an exotherm control agent, a chelating agent and a solubilizer such as sodium sulfate. Such a combination of ingredients is then thoroughly mixed and subsequently pumped into spray tower to form solid, essentially spherical granules. The bleaching granules can then be dried to the appropriate water content.

Bleaching granules prepared in this manner are then admixed with other granules of buffering agent and optional detergent composition materials, if such are desired. Actual particle size of either the bleach-containing granules, the buffering agent granules or optional granules of additional material is not critical. If, however, compositions are to be realized having commercially acceptable flow properties, certain granule size limitations are highly preferred. In general, all granules of the instant compositions preferably range in size from about 100 microns to 3000 microns, more preferably from about 100 microns to 1300 microns.

Additionally, flowability is enhanced if particles of the present invention are of approximately the same size. Therefore, preferably the ratio of the average particle sizes of the bleach-containing granules, buffering agents and optional granules of other materials varies between 0.5:1 and 2.1:1 when any two of the granules are compared.

Bleaching compositions of the present invention are utilized by dissolving them in water in an amount sufficient to provide from about 1.0 ppm to 100 ppm available oxygen, preferably from about 15 to about 45, in solution. Generally, this amounts to about 0.01% to 0.2% by weight of composition in solution. Fabrics to be bleached are then contacted with such aqueous bleaching solutions.

The bleaching compositions of the instant invention are illustrated by the following examples:

EXAMPLE I

The following is a composition within the scope of the present invention.

| | |
|---|---|
| Bleach Granule | |
| Diperoxydodecanedioic Acid (DPDA) | 18.20% |
| Dodecanedioic Acid (DA) (Impurity) | 3.80 |
| Boric Acid (Exotherm Control Agent) | 22.20 |

-continued

| | |
|---|---|
| $C_{13}$ Linear Alkyl Benzene Sulfonate (Solubilizer) | 4.36 |
| 8-Hydroxyquinoline } (Chelating System) | 0.03 |
| Phosphoric Acid } (Chelating System) | 0.04 |
| Sodium Pyrophosphate } (Chelating System) | 0.05 |
| Sodium Sulfate (Diluent and Solubilizer) | 50.32 |
| Mineral Oil (Coating) | 1.00 |
| | 100.00 |
| Buffer Granule | |
| Sodium Carbonate | 100.00 |

Ratio of amount of bleach granules to amount of buffer granules = 80:20.

The above bleach granules are prepared by forming a wet filter cake oF DPDA and the DA impurity. The DPDA is formed by the process described in U.S. Pat. No. 2,813,896, Nov. 19, 1957, to Krimm, incorporated herein by reference earlier. The filter cake, containing about 40% solids, is subsequently blended with the other ingredients, except the mineral oil. The alkyl sulfonate and the chelating system are added first followed by the addition of boric acid and sodium sulfate. This mixture is then sprayed into a cold tower operating with counter-current air flow. The spraying forms particulate granules, which granules are subsequently dried in a fluid bed dryer to a moisture level of about 0.2%. As a final step the granules are sprayed with mineral oil is rotating drum apparatus. The mineral oil serves to make the granules less dusty. in a The buffering granules (sodium carbonate) are formed such that the particle size distribution is similar to the particle size of the bleach granules. This is to provide for good flow characteristics and minimal product seregation.

The composition described above will provide a was pH of about 9.0 when dissolved in water. Another composition, outside the scope of the present invention, is prepared with no sodium carbonate present.

EXAMPLE II

The compositions of Example I are tested to determine their ability to brighten and whiten fabrics, remove stains and cause color damage to nylon fabrics. The test procedures are given below.

Materials

Dingy fabrics representing articles constructed of various fabric types are obtained. The fabrics are labeled so that they can be identified for grading purposes after the washing treatments. One-half of the fabrics are treated with one treatment and the other half with the second treatment.

In addition to the dingy fabrics colored swatches are included with each treatment. The swatches include a sensitive light blue, nylon swatch.

With each load additional fabrics are added to make a total load weight of five pounds.

Treatment Conditions

Each treatment is used with a separate fabric load. The wash solution is 17 gallons of 100° F. water which contains in addition to the fabrics, 96 grams (the recommended detergent usage) of an anionic surfactant and the test bleach. The bleach systems are used in an amount sufficient to supply 20 parts per million (ppm) available oxygen. The total wash time is 14 minutes.

The washed fabrics are rinsed in warm water using a 4 minute cycle. The fabrics are finally dried using an electric dryer with a 45 minute cycle.

Dingy Fabric Grading

Expert judges are used to grade the dingy fabrics visually for stain removal and whiteness/brightness. The judges grade fabric using a scale of 0 to 100. The "0" value represents a grade given to a low control product while the "100" value is representative of the grade given to a high control product. The grades are totalled for each treatment and divided by the number of articles graded. The average grades are representative of the effectiveness of the treatments.

Nylon Color Damage Test

The light blue nylon swatch is used for measuring color loss. The swatch is evaluated using a Hunter Color and Color Difference Meter, Model D-25, before the test treatment is performed, as well as after. The difference in color is then determined using the following equation:

$$\Delta E = \sqrt{(\Delta L)^2 + (\Delta a)^2 + (\Delta b)^2}$$

The values under the square root are the differences in Hunter Color Space coordinates found between the initial fabric color and the color after treatment. The magnitude of $\Delta E$ determines the extent of nylon color damage (i.e., large values mean severe color damage while small values mean minor damage).

Results

The average grades for whiteness/brightness and stain removal, as well as the $\Delta E$ values are given below. The buffered composition treatment has a pH of 9.0 while the unbuffered composition treatment has a pH of 8.3 as the result of the alkalinity of the anionic detergent.

| | Whiteness/ Brightness | Stain Removal | Nylon Color Damage $\Delta E$ |
|---|---|---|---|
| Diperoxydodecanedioic Acid pH 9.0 | 80 | 78 | 1.4 |
| Diperoxydodecanedioic Acid pH 8.3 | 90 | 80 | 6.6 |

It is seen that the pH 9.0 composition is significantly better than the pH 8.3 composition in terms of nylon color damage while being essentially equivalent in terms of segregation. and stain removal.

Results similar to those outlined above are achieved when sodium carbonate is replaced by an equivalent amount of another buffer such as sodium borate decahydrate, sodium phosphate or sodium pyrophosphate.

What is claimed is:

1. A method for bleaching nylon fabrics comprising contacting nylon fabrics to be bleached with a water solution containing an amount of the composition containing the following ingredients:
   (a) from about 1% to about 60% of diperoxydodecanedioic acid, and
   (b) from about 2% to about 90% of a buffering agent, wherein said acid and said buffering agent are present in the composition as separate granules and said buffering agent is present in an amount sufficient to maintain the pH of the water in which said acid is dissolved in the range of about 8.7 to about 9.5, and wherein said water solution contains a sufficient quantity of said composition to provide from about 15 ppm to about 45 ppm available oxygen.

2. A method according to claim 1 wherein the buffering agent in the composition is selected from the group consisting of alkali metal carbonates, bicarbonates, phosphates, pyrophosphates, borates, silicates and mixtures thereof.

* * * * *

UNITED STATES PATENT AND TRADEMARK OFFICE

CERTIFICATE OF CORRECTION

PATENT NO. : 4,170,453

DATED : October 9, 1979

INVENTOR(S) : David J. Kitko

It is certified that error appears in the above-identified patent and that said Letters Patent are hereby corrected as shown below:

Col. 1, line 8, "oslution" should be -- solution --.

Col. 1, line 33, "of" second occurrence. should be -- in --.

Col. 4, line 15, after "anionic" insert -- nonionic --.

Col. 5, line 60, "th" should be -- the --.

Col. 6, line 22, after "3,213,030;" insert -- 3,422,021; --.

Col. 6, line 47, "oxydissucinate" should be -- oxydisuccinate --.

Col. 8, line 17, "oF" should be -- of --.

Col. 8, line 30, delete "is" and insert -- in a --.

Col. 8, line 31, after "dusty." delete "in a".

UNITED STATES PATENT AND TRADEMARK OFFICE

CERTIFICATE OF CORRECTION

PATENT NO. : 4,170,453

DATED : October 9, 1979

INVENTOR(S) : David J. Kitko

It is certified that error appears in the above-identified patent and that said Letters Patent are hereby corrected as shown below:

Col. 8, line 37, "was" should be -- wash --.

Col. 9, line 26, the equation

" $\Delta E = \sqrt{(\Delta L)^2 + (\Delta a)^2 + (\Delta b)^2}$ " should be

-- $\Delta E = \sqrt{(\Delta L)^2 + (\Delta a)^2 + (\Delta b)^2}$ --

Col. 10, line 14, delete "segregation." and insert -- whiteness/brightness --.

Signed and Sealed this

Ninth Day of December 1980

[SEAL]

*Attest:*

SIDNEY A. DIAMOND

*Attesting Officer*

*Commissioner of Patents and Trademarks*